US009102192B2

(12) United States Patent
Taylor

(10) Patent No.: US 9,102,192 B2
(45) Date of Patent: Aug. 11, 2015

(54) PORTABLE ART EASEL

(71) Applicant: Bryan Mark Taylor, Lafayette, CA (US)

(72) Inventor: Bryan Mark Taylor, Lafayette, CA (US)

( * ) Notice: Subject to any disclaimer, the term of this patent is extended or adjusted under 35 U.S.C. 154(b) by 408 days.

(21) Appl. No.: 13/773,472

(22) Filed: Feb. 21, 2013

(65) Prior Publication Data

US 2013/0270411 A1 Oct. 17, 2013

Related U.S. Application Data

(60) Provisional application No. 61/686,807, filed on Apr. 11, 2012.

(51) Int. Cl.

| | |
|---|---|
| ***A47B 97/04*** | (2006.01) |
| ***B44D 3/00*** | (2006.01) |
| ***B44D 3/18*** | (2006.01) |
| ***A47B 97/08*** | (2006.01) |

(52) U.S. Cl.

CPC . *B44D 3/00* (2013.01); *A47B 97/08* (2013.01); *B44D 3/185* (2013.01)

(58) Field of Classification Search

CPC ..... A47B 97/08; A47B 41/06; A47B 41/04; B44D 3/185; B44D 3/00

USPC ..... 248/441.1, 450, 454, 455, 457, 456, 248/460, 463, 447, 449, 448, 451, 452, 453, 248/444, 461, 462, 464; 108/9, 35, 36, 44, 108/43, 6, 25, 26; 312/231; 206/557

See application file for complete search history.

(56) References Cited

U.S. PATENT DOCUMENTS

| | | | | | |
|---|---|---|---|---|---|
| 815,810 | A * | 3/1906 | Goldsworthy | 312/231 |
| 1,178,597 | A * | 4/1916 | Owens | 108/34 |
| 2,586,524 | A * | 2/1952 | Dussardier | 312/231 |
| 2,638,397 | A * | 5/1953 | Wykoff | 312/231 |
| 2,693,258 | A * | 11/1954 | Fleisch | 190/11 |
| 2,751,271 | A * | 6/1956 | Dessertenne et al. | 312/231 |
| 3,168,363 | A * | 2/1965 | Monsour | 312/231 |
| 3,202,471 | A * | 8/1965 | Wilson | 312/231 |
| 3,378,322 | A * | 4/1968 | Johnson | 312/231 |
| 4,093,326 | A * | 6/1978 | Ford | 312/231 |
| 4,149,763 | A * | 4/1979 | Delahaie | 312/231 |
| 4,372,630 | A * | 2/1983 | Fuhri | 312/231 |
| 5,833,201 | A * | 11/1998 | Graybill | 248/462 |
| 6,745,988 | B2 * | 6/2004 | Gelfand | 248/460 |
| 7,188,818 | B2 * | 3/2007 | Chang | 248/460 |
| 7,717,393 | B2 * | 5/2010 | Edgmon et al. | 248/460 |
| 2005/0279907 | A1 * | 12/2005 | Park | 248/460 |

* cited by examiner

*Primary Examiner* — Kimberly Wood

(74) *Attorney, Agent, or Firm* — Kirton McConkie; Brian Tucker

(57) ABSTRACT

The present invention extends to a portable art easel that is lightweight, contains minimal parts, and is easy to transport and set-up thereby facilitating the use of the easel in virtually any desired location. The portable easel can be configured to form a box shape when closed making the easel easily transportable. The lid of the box shape can be folded open and include an adjustable canvas holder for supporting a canvas while the bottom portion of the box shape can serve as a palette or palette holder. The bottom portion can also be configured to attach to a tripod.

20 Claims, 15 Drawing Sheets

PORTABLE ART EASEL

CROSS-REFERENCE TO RELATED APPLICATIONS

This application claims the benefit of U.S. Provisional Patent Application No. 61/686,807, filed Apr. 11, 2012, and titled "Portable Artist Easel and Palette."

BACKGROUND

Conventional easels on the market today are heavy, bulky, made primarily out of wood or metal, and contain many parts that require hours of assembly and set-up. Although some of these easels are portable, it is difficult to transport, set-up, and take down such easels thus making their use less desirable when painting in different locations.

For example, many of these easels have many different parts, some of which protrude from the general shape of the easel, which make it difficult to transport the easels easily such as in a bag, luggage, or other carrier. Also, because the easels are relatively heavy, it can be difficult to manually transport them to various locations such as in nature.

Further, even if the artist is able to transport the easels to a desired location, it often requires a substantial amount of time and effort to set-up the easels in a desired configuration. Similar time and effort may also be required when taking down the easels after finishing a work or to move to another location. Additionally, due to their complexity, these easels are prone to breaking.

BRIEF SUMMARY

The present invention extends to a portable art easel that is lightweight, contains minimal parts, and is easy to transport and set-up thereby facilitating the use of the easel in virtually any desired location. The portable easel can be configured to form a box shape when closed making the easel easily transportable. The lid of the box shape can be folded open and include an adjustable canvas holder for supporting a canvas while the bottom portion of the box shape can serve as a palette or palette holder.

In one embodiment, a portable easel comprises a box shaped container that includes a bottom portion and a lid connected to the bottom portion along a first side thereby allowing the lid to close over the bottom portion. The bottom portion further includes an opening positioned on a second side opposite the first side.

The portable easel also comprises a holder plate positioned on an inside surface of the lid; an upper canvas holder secured to the lid by the holder plate, the upper canvas holder being adjustable to extend a top portion of the upper canvas holder away from the lid, the top portion having one or more raised edges; a lower canvas holder secured to the lid by the holder plate, the lower canvas holder configured to support a canvas placed thereon; and a stopper positioned within the opening in the container to form a gap into which the one or more raised edges of the top portion of the upper canvas holder insert to lock the lid in a closed position.

This summary is provided to introduce a selection of concepts in a simplified form that are further described below in the Detailed Description. This Summary is not intended to identify key features or essential features of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present invention extends to a portable art easel that is lightweight, contains minimal parts, and is easy to transport and set-up thereby facilitating the use of the easel in virtually any desired location. The portable easel can be configured to form a box shape when closed making the easel easily transportable. The lid of the box shape can be folded open and include an adjustable canvas holder for supporting a canvas while the bottom portion of the box shape can serve as a palette or palette holder.

In one embodiment, a portable easel comprises a box shaped container that includes a bottom portion and a lid connected to the bottom portion along a first side thereby allowing the lid to close over the bottom portion. The bottom portion further includes an opening positioned on a second side opposite the first side.

The portable easel also comprises a holder plate positioned on an inside surface of the lid; an upper canvas holder secured to the lid by the holder plate, the upper canvas holder being adjustable to extend a top portion of the upper canvas holder away from the lid, the top portion having one or more raised edges; a lower canvas holder secured to the lid by the holder plate, the lower canvas holder configured to support a canvas placed thereon; and a stopper positioned within the opening in the container to form a gap into which the one or more raised edges of the top portion of the upper canvas holder insert to lock the lid in a closed position.

Figure 1:
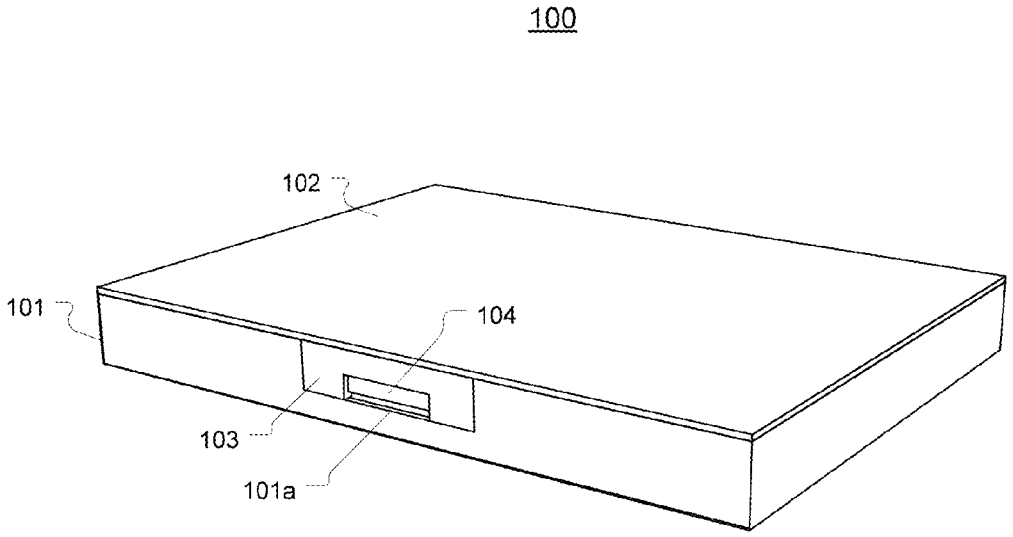
FIG. 1 illustrates a portable easel in a closed configuration.

FIG. 1 illustrates a portable easel 100 in a closed configuration according to one or more embodiments of the present invention. Easel 100 is a generally box-shaped container formed by bottom 101 and lid 102. A front wall of bottom 101 includes an opening 101*a* within which a stopper 104 (either formed in the front wall or attached thereto) is positioned. Stopper 104 is positioned so that a gap is formed between a top edge of opening 101*a* and a bottom edge of stopper 104 into which a portion of upper canvas holder 103 can insert to hold easel 100 in a closed position.

Figure 2:
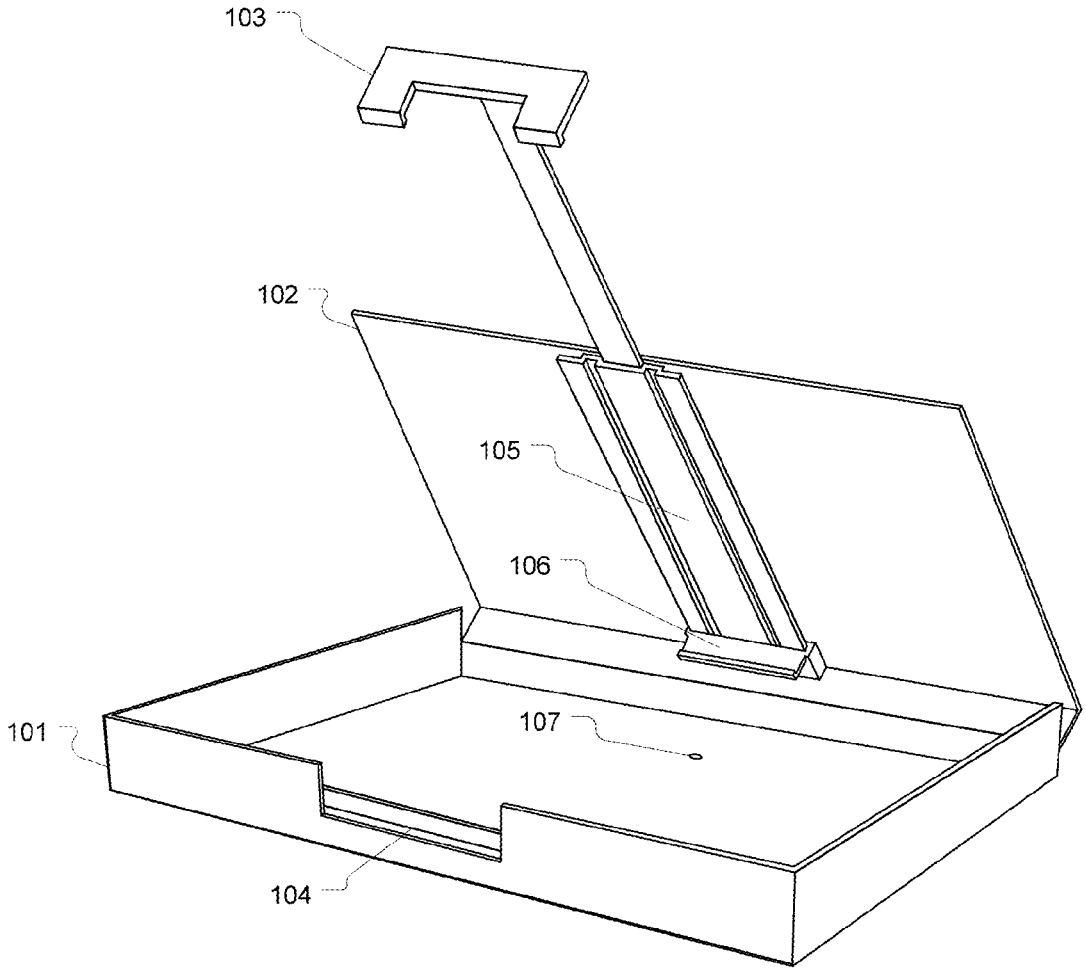
FIG. 2 illustrates a portable easel in an open configuration.

FIG. 2 illustrates easel 100 in an open configuration according to one or more embodiments of the invention. As shown, a holder plate 105 is attached to (or formed within) the underside of lid 102. Holder plate 105 has a raised profile so that three channels (two side channels and a middle channel shown as 701*a*, 701*b*, and 702 respectively in FIG. 7B) are formed between holder plate 105 and lid 102. Upper canvas holder 103 includes an extension (shown as 601 in FIG. 6A) that slides up and down within the middle channel. Similarly, a lower canvas holder 106 includes outer brackets (shown as 501*a* and 501*b* in FIG. 5A) which wrap around the outer edges of holder plate 105 and into the outer channels.

Upper canvas holder 103 can be extended upwardly from holder plate 105 to accommodate canvases of different heights. In some embodiments, the clearance between the middle channel and the extension of upper canvas holder 103 can be tight enough so that sufficient friction is provided to retain upper canvas holder 103 in position.

In some embodiments, lower canvas holder 106 can be fixed (i.e. non-adjustable), while in other embodiments, lower canvas holder 106 can be adjustable. For example, lower canvas holder 106 can include a thumb screw or other means for securing lower canvas holder in place against holder plate 105.

Figure 15:
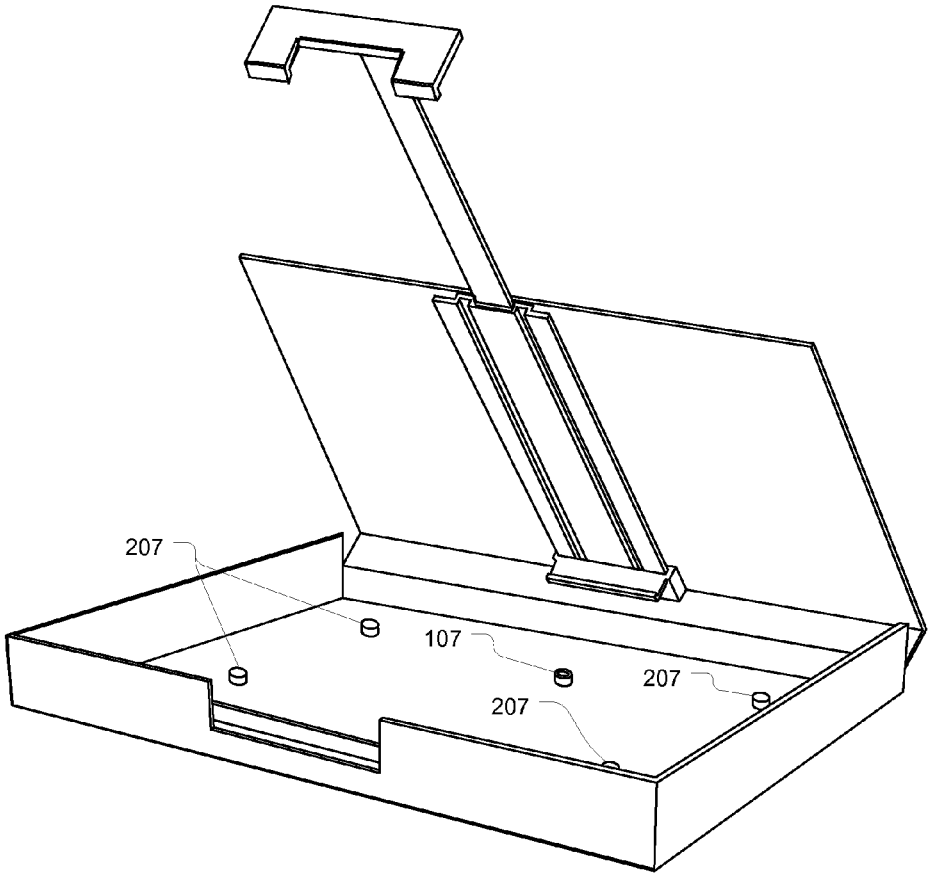
FIG. 15 illustrates another embodiment of a portable easel in which the bottom of the portable easel includes a hole for attaching a tripod and a number of protrusions for providing a flat surface on which a palette can be placed.

An inside surface of bottom 101 can be formed of a non-porous material to allow the inside surface to be used as a palette. Bottom 101 can also include a hole 107 that is configured to allow bottom 101 to be attached to a tripod (e.g. via threads). In this way, easel 100 can be placed on top of many different tripods to facilitate the positioning of easel 100 in many different locations and settings. In some embodiments, hole 107 can be formed using a separate piece attached to the inside surface of bottom 101 (e.g. a piece that includes threads such as a nut) such as is shown in FIG. 15. In such cases, additional pieces or protrusions 207 can be included on the inside surface of bottom 101 so that when a palette is placed inside bottom 101, the palette will lie flat on each of the pieces/protrusions 107/207.

Figure 3:
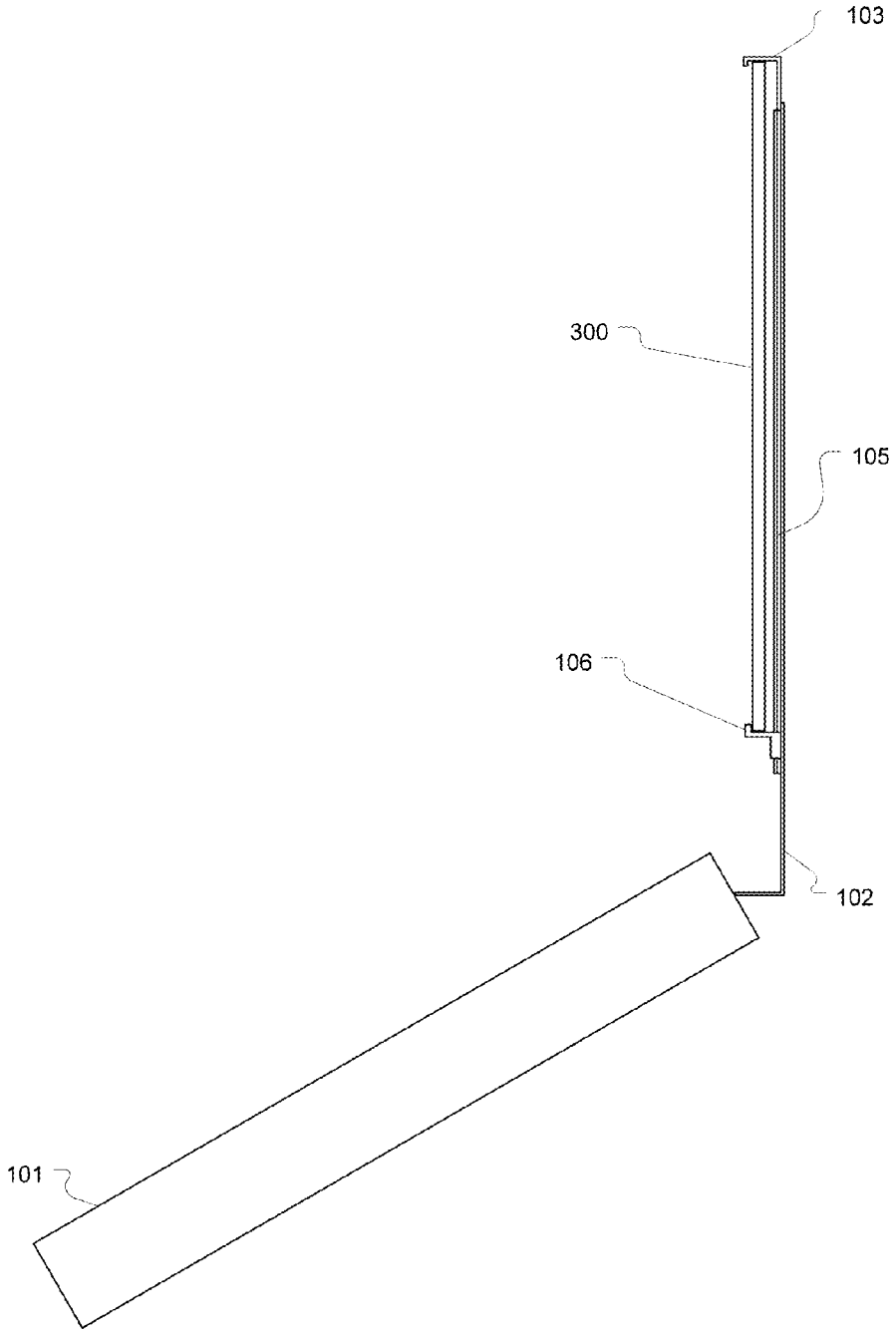
FIG. 3 illustrates a side view of a portable easel in an open configuration.

FIG. 3 illustrates a side view of easel 100 in an open configuration with a canvas 300 being held between upper canvas holder 103 and lower canvas holder 106. As shown, upper canvas holder 103 has been extended upwardly from lid 102 to accommodate the height of canvas 300. In embodiments where lower canvas holder 106 is also adjustable, the relative vertical position of canvas 300 can be adjusted by moving upper and lower canvas holders 103, 106 up or down.

Figure 4A:
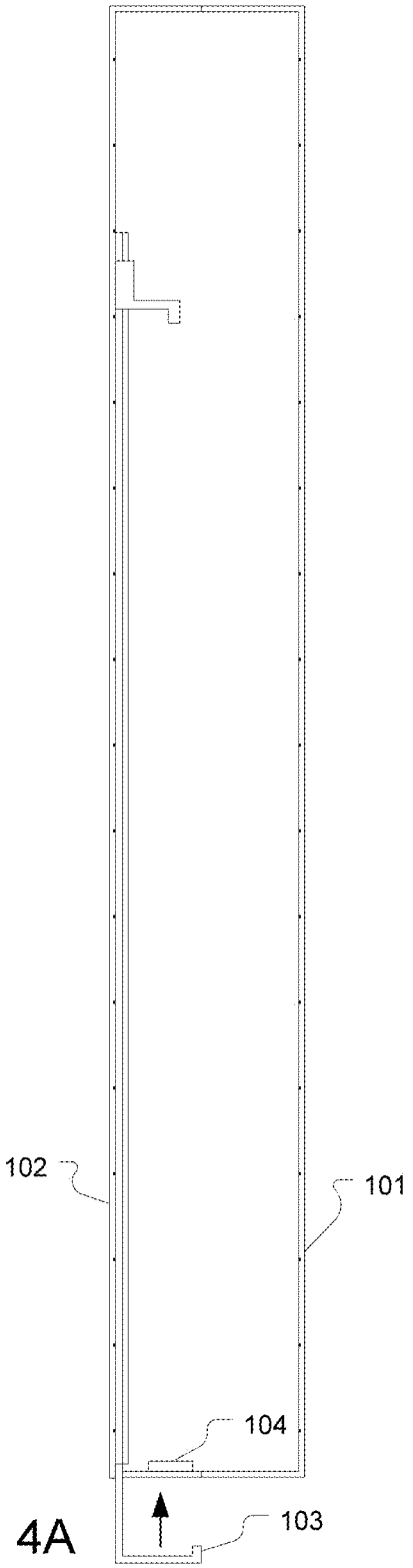
FIGS. 4A and 4B each illustrate a cut-away side view of a portable easel.
Figure 4B:
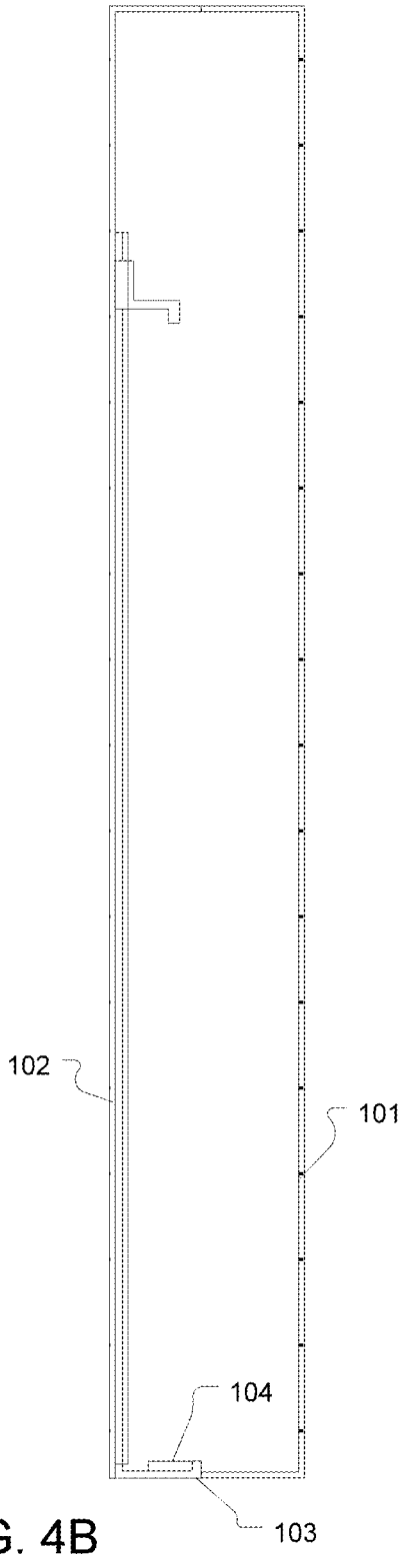

FIGS. 4A and 4B each illustrate a cut-away side view of easel 100. In FIG. 4A, lid 102 is shut while upper canvas holder 103 remains somewhat extended. In this position, easel 100 is in a closed but unlocked configuration. As shown in FIG. 4B, upper canvas holder 103 has been pushed into the opening formed in the front wall of bottom 101 to the point that the raised edges (shown as 602*a* and 602*b* in FIG. 6A) of upper canvas holder 103 wrap around stopper 104. In this position, lid 102 cannot be opened.

FIGS. 5A-5D illustrate a perspective, top, back, and side view respectively of an example configuration of lower canvas holder 106. As labeled in FIG. 5A, lower canvas holder 106 includes outer brackets 501*a*, 501*b* which wrap around the outer edges of holder plate 105 to prevent lower canvas holder 106 from being removed from holder plate 105. Lower canvas holder 106 also includes ledge 502 on which a canvas can be placed. Ledge 502 can include a raised edge to prevent the canvas from sliding off. FIG. 5E illustrates another embodiment of lower canvas holder 106 in which ledge 502 includes two protrusions 510 which can be used to hold a canvas. Protrusions 510 can be adjustable in some implementations to allow protrusions 510 to be adjusted to accommodate canvases of different thicknesses. Alternatively, rather than using separate protrusions, the raised edge of ledge 502 can be configured to be adjustable.

Figure 5B:
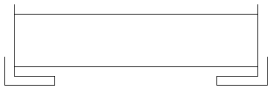
FIGS. 5A-5D illustrate various views of a lower canvas holder.
Figure 5A:
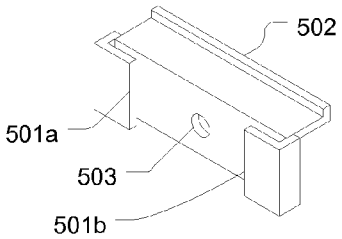
Figure 5C:
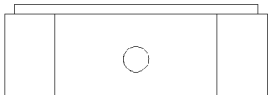
Figure 5D:
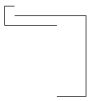
Figure 5E:
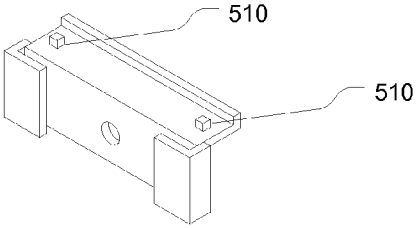
FIG. 5E illustrates an alternative embodiment of a lower canvas holder.
Figure 6A:
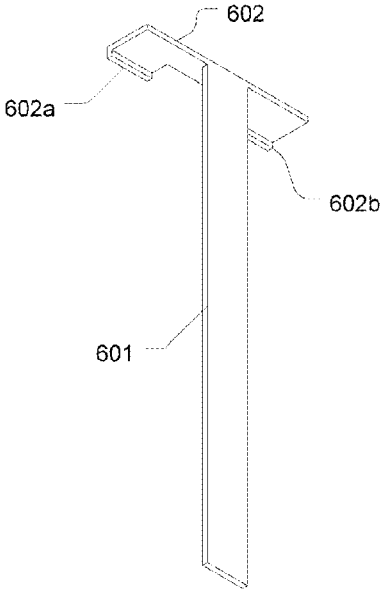
FIGS. 6A-6E illustrate various views of an upper canvas holder.
Figure 6B:
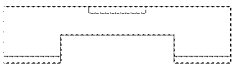
Figure 6C:
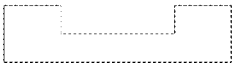
Figure 6D:
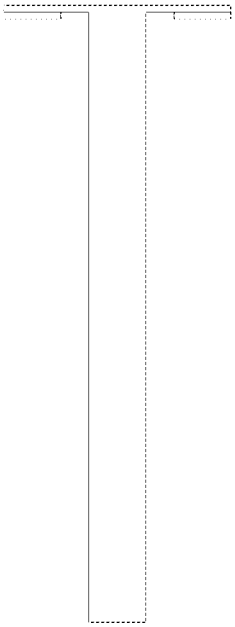
Figure 6E:
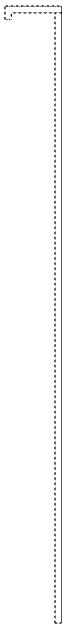

In some embodiments, as shown in FIGS. 5A and 5C, lower canvas holder 106 can include a hole 503 through which a thumb screw can be tightened to secure lower canvas holder 106 in a particular position against holder plate 105.

FIGS. 6A-6E illustrate a perspective, bottom, top, back, and side view respectively of an example configuration of upper canvas holder 103. As labeled in FIG. 6A, upper canvas holder 103 includes extension 601 which is inserted into the middle channel formed between holder plate 105 and lid 102. Upper canvas holder 103 also includes a top portion 602 with raised edges 602*a*, 602*b*. Raised edges 602*a*, 602*b* (which in some embodiments may comprise a single raised edge that extends along a portion of the entirety of upper canvas holder 103) can function to hold a canvas as well as to lock easel 100 as described above with respect to FIG. 4B. Although not shown, upper canvas holder 103 can include protrusions similar to protrusions 510 which may be adjustable in some implementations. Similarly, raised edges 602*a*, 602*b* can also be configured to be adjustable.

Figure 7B:
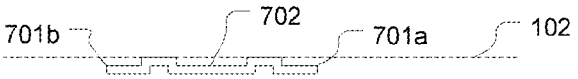
FIGS. 7A-7D illustrate various views of a holder plate.
Figure 7C:
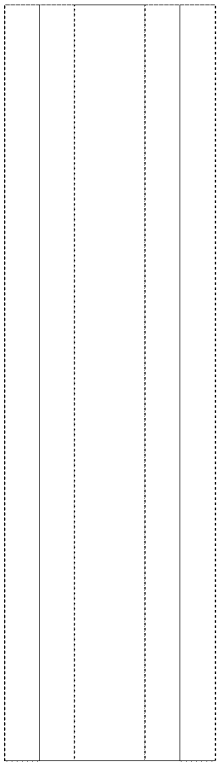
Figure 7D:
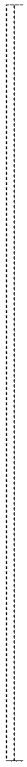
Figure 7A:
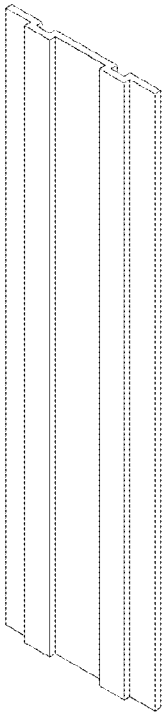

FIGS. 7A-7D illustrate a perspective, top, front, and side view respectively of an example configuration of holder plate 105. The perspective view in FIG. 7A shows the back surface of holder plate 105 (i.e. the surface that is against lid 102). In FIG. 7B, a portion of lid 102 is represented as a dashed line to illustrate middle channel 702 and outer channels 701*a*, 701*b* that are formed when holder plate 105 is attached to lid 102.

Although holder plate 105 is described as being attached to lid 102, it is also possible to form holder plate 105 within the same material used to form lid 102. Also, the example of holder plate 105 depicted in FIGS. 7A-7D includes two indentations on the front side. However, such indentations are not required (i.e. the front surface of holder plate 105 can be flat).

Although not shown in the figures, in some embodiments, holder plate 105 can be configured differently so that any or all of outer channels 701*a*, 701*b* and middle channel 702 are formed on an opposite side of holder plate 105 than is depicted. For example, holder plate 105, upper canvas holder 103, and lower canvas holder 106 can be configured inversely while still providing similar functionality. Accordingly, the specific shape of these components is not essential to the invention.

Figure 8B:
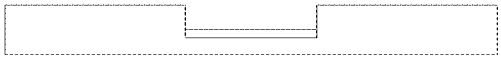
FIGS. 8A-8C illustrate various views of a bottom portion of a portable easel.
Figure 8C:
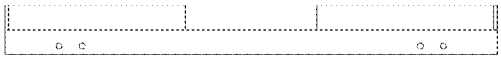
Figure 8A:
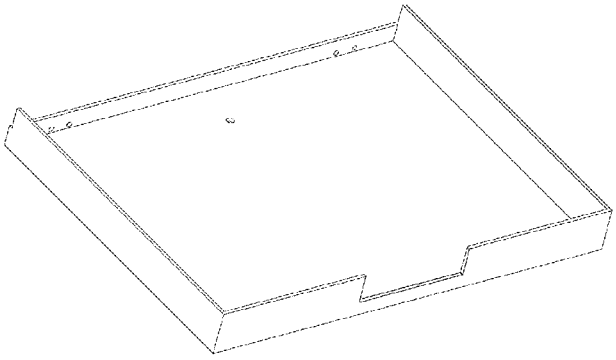
Figure 12:
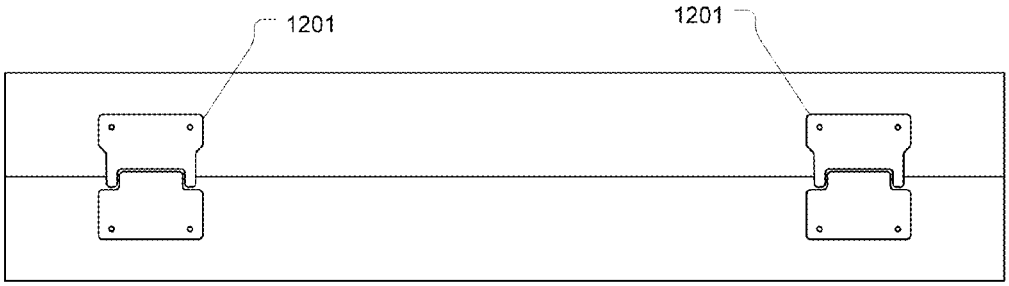
FIG. 12 illustrates hinges that can be used to connect the lid and bottom portion of a portable easel together.

FIGS. 8A-8C illustrate a perspective, front, and back view respectively of bottom 101. As shown, the back side of bottom 101 can be lower than the other sides to facilitate the placement of hinges as shown in FIG. 12. Bottom 101 also can include a hole that is configured to attach to a tripod as described above.

Figure 9A:
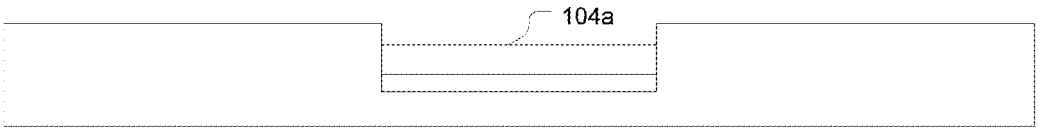
FIGS. 9A-9C illustrate different configurations of a stopper.
Figure 9B:
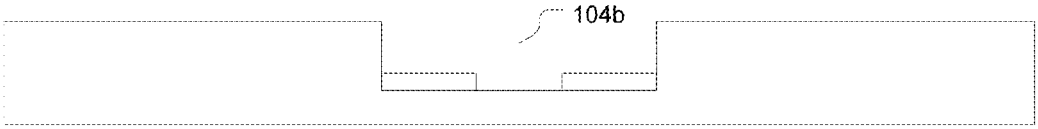
Figure 9C:
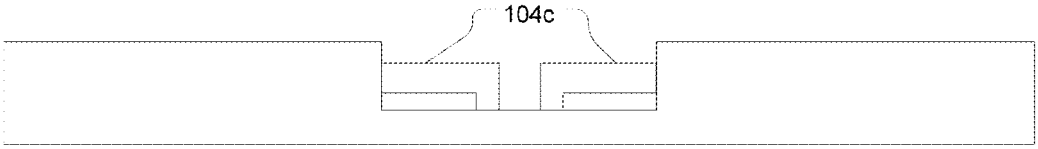

FIGS. 9A-9C each illustrate a different configuration of stopper 104. In FIG. 9A stopper 104*a* is similar to stopper 104 shown in the previous figures. In FIG. 9B, stopper 104*b* has a T-shape forming openings on both sides into which the raised edges 602*a*, 602*b* of upper canvas holder 103 can be inserted. In FIG. 9C, stopper 104*c* is comprised of two separate pieces. The configuration shown in FIG. 9C can be preferred in many cases because it creates an opening through which the user can insert a finger to pull raised edges 602*a*, 602*b* out to unlock easel 100. Accordingly, stopper 104 can have many different configurations.

Figure 10:
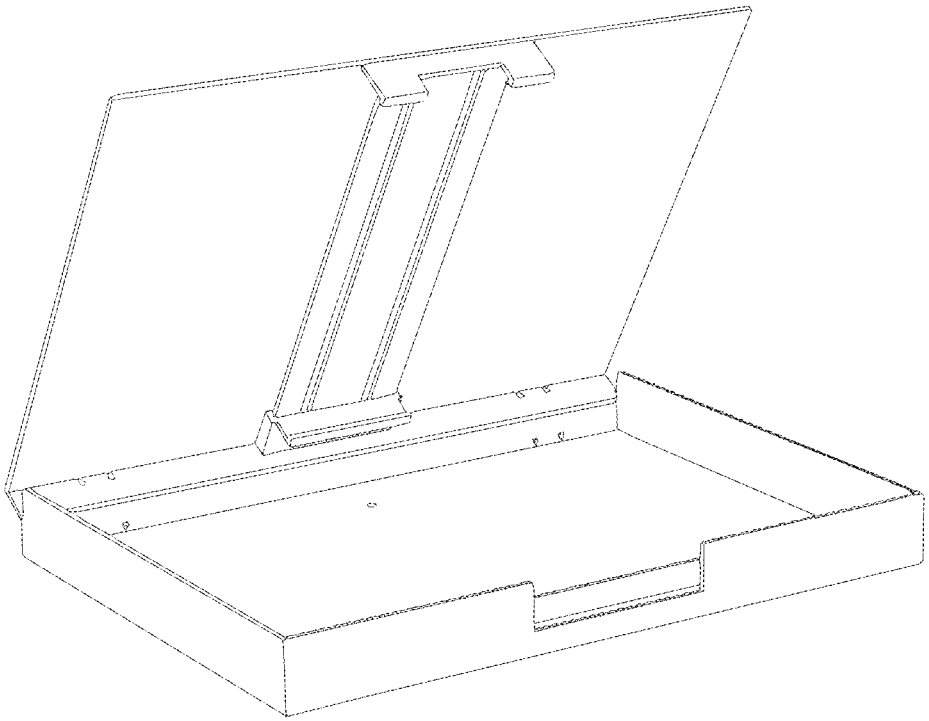
FIGS. 10 and 11 illustrate an easel with the upper canvas holder closed and extended respectively.
Figure 11:
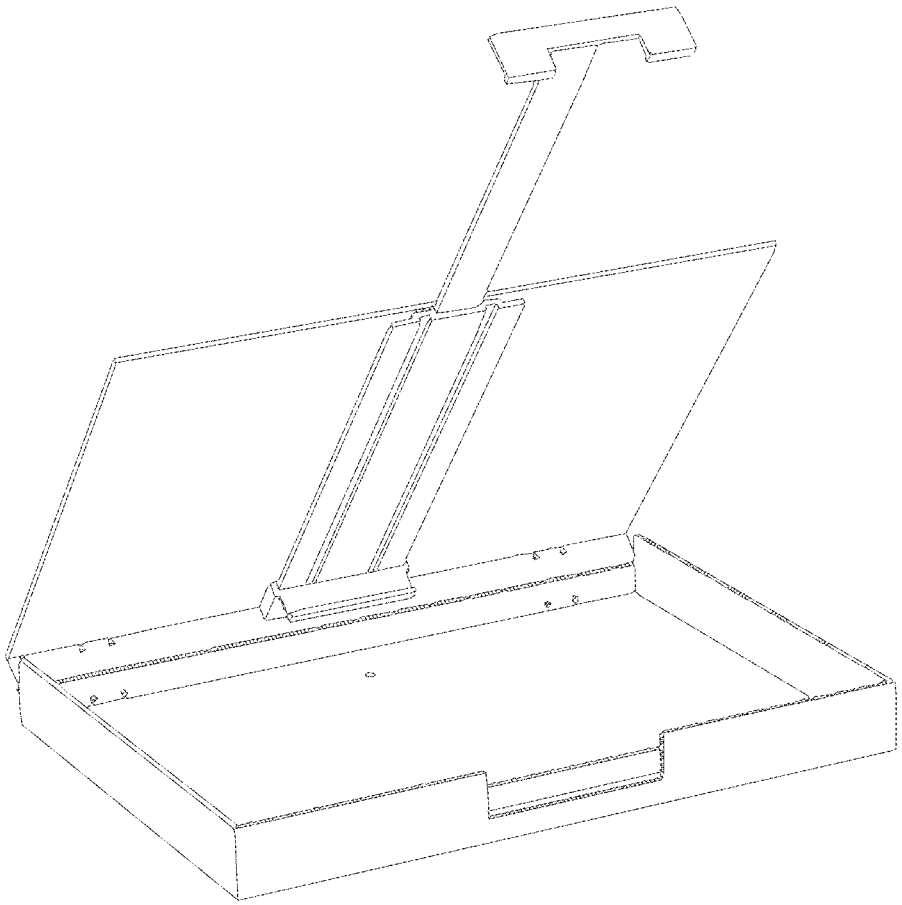

FIG. 10 illustrates easel 100 when lid 102 is open and extension 701 of upper canvas holder 103 is slid completely inside middle channel 702. FIG. 11, on the other hand, illustrates easel 100 when upper canvas holder 103 has been extended from middle channel 702.

FIG. 12 illustrates an example of hinges 1201 that can be used to connect lid 102 to bottom 101. Hinges 1201 can be friction (or position) hinges which allow the relative position between lid 102 and bottom 101 to be maintained (e.g. similar to a laptop). Although FIG. 12 shows two hinges being used, it is also possible to use one (e.g. a single continuous hinge) or more hinges.

Figure 13:
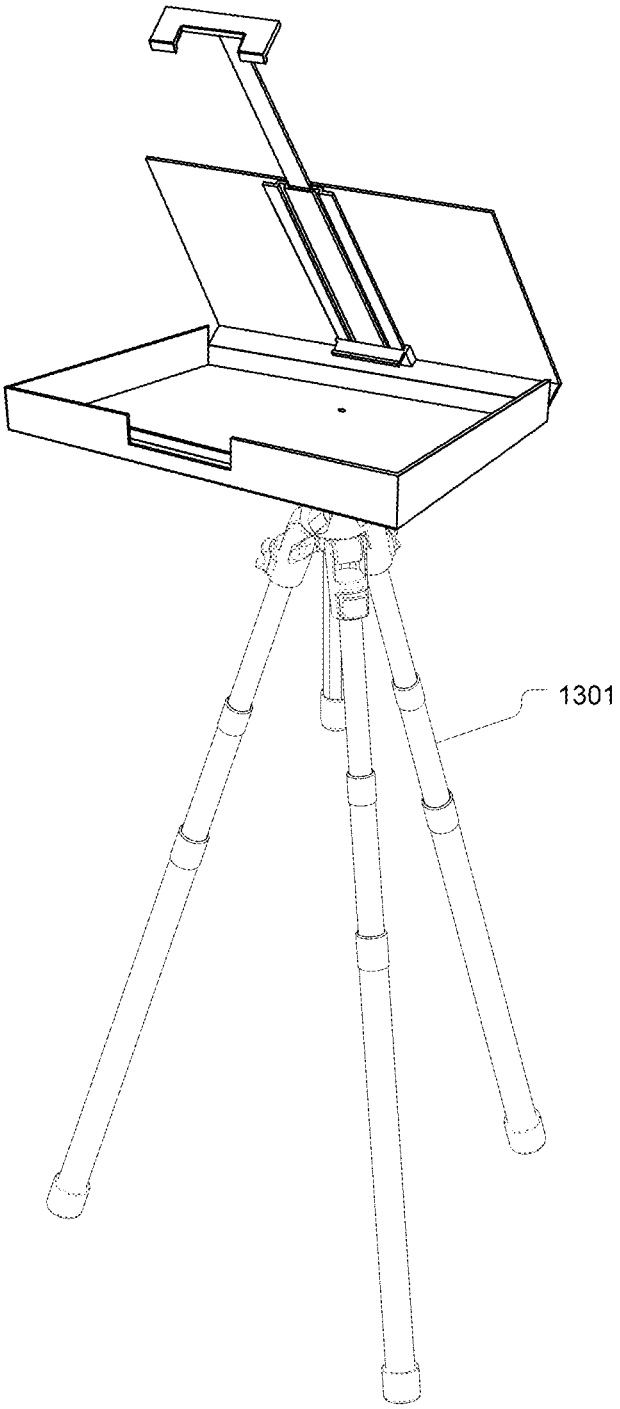
FIG. 13 illustrates a portable easel attached to a tripod.

FIG. 13 illustrates easel 100 when attached to a tripod 1301. In some embodiments, bottom 101 can include a hole or other receptacle that is configured to allow bottom 101 to attach to a standard tripod mount. Because easel 100 and many tripods are easily transportable and quick to set-up, this configuration facilitates the use of easel 100 in remote locations.

Figure 14:
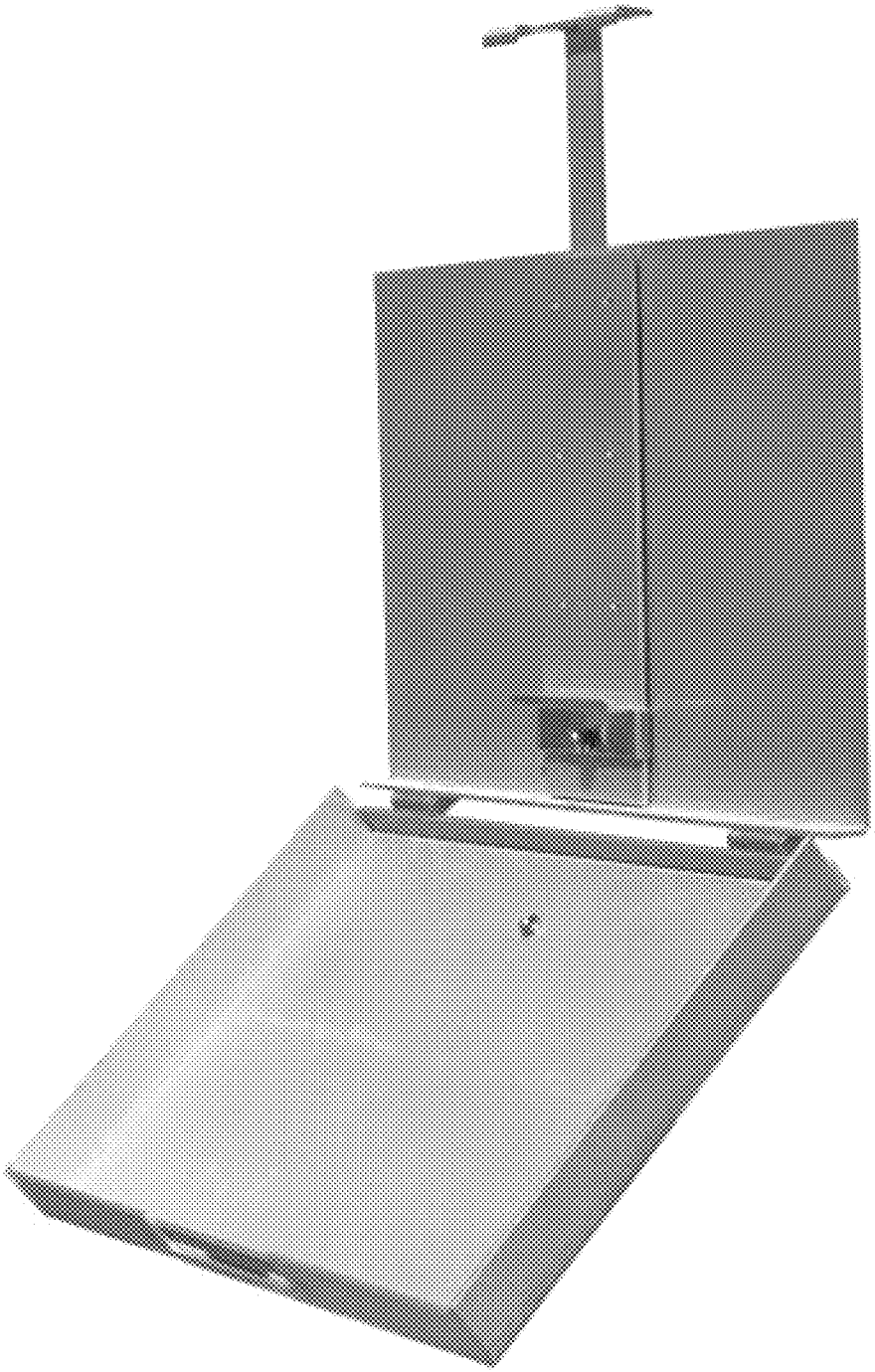
FIG. 14 illustrates another embodiment of a portable easel.

FIG. 14 illustrates another embodiment of an easel 1400. Easel 1400 includes a stopper similar to stopper 104*b* and also includes a holder plate with a flat front surface. Easel 1400 is made of sheet metal which provides a light-weight sturdy material which can also serve as a palette (e.g. on the inside bottom surface).

An easel according to embodiments of the invention can be made of many different materials and can have many different sizes. A lightweight sturdy material is preferable to maintain the transportability of the easel design. For example, an easel can be made of various metals, plastics, or fiberglass.

As can be seen in the figures, the design of the portable easel is simple while still providing desired functionality. When closed, the easel is a box having no protrusions thereby making it much easier to carry, slide in and out of a bag or other carrier, or otherwise transport.

This design also allows the easel to be used as a palette or a palette holder. Specifically, when opened, the inside of bottom 101 can serve as a palette or as a location where a separate palette can be placed. In this manner, the easel's ease of use is further increased.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A portable easel comprising:

a box shaped container including a bottom portion and a lid connected to the bottom portion along a first side thereby allowing the lid to close over the bottom portion, the bottom portion further including an opening positioned on a second side opposite the first side;

a holder plate positioned on an inside surface of the lid;

an upper canvas holder secured to the lid by the holder plate, the upper canvas holder being adjustable to extend a top portion of the upper canvas holder away from the lid, the top portion having one or more raised edges;

a lower canvas holder secured to the lid by the holder plate, the lower canvas holder configured to support a canvas placed thereon; and a stopper positioned within the opening in the container to form a gap into which the one or more raised edges of the top portion of the upper canvas holder insert to lock the lid in a closed position.

2. The portable easel of claim 1, wherein the box-shaped container is rectangular.

3. The portable easel of claim 1, wherein the holder plate includes a raised profile that forms a middle channel and two side channels between the holder plate and the lid.

4. The portable easel of claim 3, wherein the upper canvas holder includes an extension that inserts into the middle channel thereby securing the upper canvas holder to the lid and enabling the top portion of the upper canvas holder to be extended away from the lid.

5. The portable easel of claim 3, wherein the lower canvas holder includes outer brackets which wrap around the holder plate and insert into the side channels to secure the lower canvas holder to the holder plate.

6. The portable easel of claim 5, wherein the position of the lower canvas holder on the holder plate is adjustable by sliding the outer brackets within the side channels.

7. The portable easel of claim 6, wherein the lower canvas holder includes a thumb screw for fixing the position of the lower canvas holder on the holder plate.

8. The portable easel of claim 1, wherein the lower canvas holder includes a ledge with a raised edge to prevent the canvas placed thereon from sliding off the ledge.

9. The portable easel of claim 1, wherein the gap is formed between a top edge of the second side of the bottom portion and a bottom edge of the stopper.

10. The portable easel of claim 1, wherein the one or more raised edges on the top portion of the upper canvas holder comprise two raised edges positioned on opposite sides of the top portion, and wherein the stopper comprises one or more components that the gap as form two side gaps into which the two raised edges insert and a middle gap into which a user can insert a finger to pull the two raised edges out from the two side gaps.

11. The portable easel of claim 1, wherein the bottom portion includes a hole configured to allow the bottom portion to be attached to a tripod.

12. The portable easel of claim 1, wherein the lid is connected to the bottom portion by one or more hinges.

13. The portable easel of claim 12, wherein the one or more hinges comprise friction hinges which maintain the relative position of the lid with respect to the bottom portion.

14. The portable easel of claim 1, wherein the first side of the bottom portion is lower than another side of the bottom portion.

15. The portable easel of claim 1, wherein an inside surface of the bottom portion is comprised of a non-porous material which provides a surface which can serve as a palette.

16. The portable easel of claim 1, wherein an inside surface of the bottom portion includes a plurality of protrusions that form a raised surface on which a palette can be placed, the plurality of protrusions including a threaded protrusion around a hole formed in the bottom portion, the threaded protrusion being configured to allow the bottom portion to be attached to a tripod.

17. A portable easel comprising:

a box shaped container including a bottom portion and a lid having a hinged connection to the bottom portion along a first side thereby allowing the lid to close over the bottom portion, the bottom portion further including an opening positioned on a second side opposite the first side;

a holder plate positioned on an inside surface of the lid, the holder plate having a raised profile that forms a middle channel and two side channels between the holder plate and the lid;

an upper canvas holder having an extension that inserts into the middle channel thereby securing the upper canvas holder to the lid, the upper canvas holder being adjustable by sliding the extension within the middle channel to extend a top portion of the upper canvas holder away from the lid, the top portion having one or more raised edges;

a lower canvas holder secured to the lid by the holder plate, the lower canvas holder configured to support a canvas placed thereon; and a stopper positioned within the opening in the container to form a gap into which the one or more raised edges of the top portion of the upper canvas holder insert to lock the lid in a closed position.

18. The portable easel of claim 17, wherein the lower canvas holder includes outer brackets which wrap around the holder plate and insert into the side channels to secure the lower canvas holder to the holder plate.

19. A portable easel comprising:

a box shaped container including a bottom portion and a lid connected to the bottom portion along a first side thereby allowing the lid to close over the bottom portion, the bottom portion further including an opening positioned on a second side opposite the first side;

a holder plate positioned on an inside surface of the lid;

an upper canvas holder secured to the lid by the holder plate, the upper canvas holder being adjustable to extend a top portion of the upper canvas holder away from the lid, the top portion having one or more raised edges;

a lower canvas holder secured to the lid by the holder plate, the lower canvas holder configured to support a canvas placed thereon; and a stopper positioned within the opening in the container to form a gap between a top edge of the second side of the bottom portion and a bottom edge of the stopper, wherein the one or more raised edges of the top portion of the upper canvas holder insert into the gap when the lid is in closed position to lock the lid in the closed position.

20. The portable easel of claim 19, wherein the lid is connected to the bottom portion by one or more friction hinges which maintain the relative position of the lid with respect to the bottom portion.

* * * * *